US007404275B2

(12) United States Patent
Stenner

(10) Patent No.: US 7,404,275 B2
(45) Date of Patent: Jul. 29, 2008

(54) LABELING MACHINE FOR BEVERAGE BOTTLING PLANT

(75) Inventor: Holger Stenner, Haltern am See (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 0 days.

(21) Appl. No.: 11/404,580

(22) Filed: Apr. 14, 2006

(65) Prior Publication Data

US 2006/0266479 A1 Nov. 30, 2006

(51) Int. Cl.
*B65B 61/20* (2006.01)
*B65C 3/16* (2006.01)

(52) U.S. Cl. ..... 53/135.1; 156/DIG. 9; 156/DIG. 12; 156/DIG. 14

(58) Field of Classification Search ..... 53/135.1; 156/556, 542, 361, 541, 33, DIG. 33, DIG. 12–14, 156/DIG. 39, DIG. 9
See application file for complete search history.

(56) References Cited

U.S. PATENT DOCUMENTS

| | | | | |
|---|---|---|---|---|
| 4,267,004 A | | 5/1981 | Anderson et al. | |
| 5,078,816 A | | 1/1992 | Ratermann et al. | |
| 5,162,069 A | * | 11/1992 | Morris | 156/363 |
| 5,188,696 A | | 2/1993 | Good, Jr. et al. | |
| 5,925,214 A | * | 7/1999 | Klein et al. | 156/556 |
| 6,276,221 B1 | * | 8/2001 | Grushansky et al. | 73/865.9 |

FOREIGN PATENT DOCUMENTS

| | | |
|---|---|---|
| DE | 23 08 373 | 9/1974 |
| DE | 34 16 658 A1 | 11/1985 |
| DE | 36 21 879 | 1/1988 |
| DE | 199 42 310 | 3/2001 |
| EP | 0 624 522 A | 11/1994 |
| EP | 1 122 175 A | 8/2001 |
| EP | 1 418 127 A | 5/2004 |

* cited by examiner

*Primary Examiner*—Hemant M. Desai
(74) *Attorney, Agent, or Firm*—Nils H. Ljungman & Associates

(57) ABSTRACT

A beverage bottling plant for filling bottles having non-cylindrical inclined surfaces with a liquid beverage filling material. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 9 Drawing Sheets

LABELING MACHINE FOR BEVERAGE BOTTLING PLANT

BACKGROUND

1. Technical Field

The present application relates to a beverage bottling plant for filling bottles having non-cylindrical inclined surfaces with a liquid beverage filling material.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

The labeling of containers or cans, for example, or cartons or similar objects is of particular importance in the beverage and packing industry because an advantageous and attractive labeling of the containers represents a major contribution to the successful sale of a product.

The prior art describes numerous different methods that can be used for the labeling of bottles, cans, glasses, cartons etc. These methods also include methods for providing the containers with printed, self-adhesive film segments, which are also called self-adhesive labels, whereby these labels at least partly surround the peripheral surfaces of the container.

To facilitate the processing of self-adhesive labels of this type, the prior art teaches that the labels are not stored and processed loosely and individually in the corresponding labeling machines as they are, for example, in the type of machine that is used for the processing of single-sheet paper labels. Instead, the manufacturing process of these self-adhesive labels is designed so that at the end of their manufacturing process, the self-adhesive labels are positioned on a backing film that is realized in the form of a long, narrow strip. The backing film provided with the self-adhesive labels is coiled up and then fed in the form of a roll of labels, which can contain several thousand, e.g. 16,000 self-adhesive labels, to a suitable labeling machine and is processed in said machine.

In industrial practice, it has become common to call the backing film provided with self-adhesive labels Label Strip 13.

As the self-adhesive labels are processed, the label strip is unwound from a label strip roller and is guided in an appropriate manner through the labeling machine. At a point that is in close proximity to the beverage containers or cartons to be labeled, the label strip is guided over a sharp edge—which is also called the dispensing edge—during which process it is bent at a sharp angle. The label located on the label strip is thereby unable to bend as sharply as the label strip and therefore becomes detached from the label strip, as a result of which it is available for the subsequent labeling process. Then the label strip 13, which as a result of the detachment of the labels has become what is now called the backing film 14, is transported further through the labeling machine and wound up on a take-up device so that it is easy to handle and dispose of.

One of the tasks that comes up again and again during the operation of a labeling machine is the need to label containers that have inclined surfaces, i.e. surfaces that are inclined at an angle with respect to the vertical, whereby it is also desirable to attach the labels so that they are at least partly located on these inclined surfaces.

During the processing of self-adhesive labels, it is particularly advantageous to apply the labels to the surface to be labeled in an orientation in which the dispensing edge and the surface to be labeled are essentially parallel to each other.

For this reason, in the past, labeling stations have been proposed in which the entire labeling station can be pivoted around an axis of rotation that is oriented horizontally in space, as a result of which an orientation of the dispensing edge parallel to the surface to be labeled is achieved, which corresponds to what is called the working position.

However, one consequence of this method is that the label strip and backing strip rollers, which are conventionally located on the rear end of the labeling station, track the pivoting movement, and therefore move farther away from the ground or the floor of the building and are sometimes so high that they are either totally out of reach or can be accessed only with difficulty.

On account of the great weight of label strip and backing strip rolls and of the great distance between the mounting positions of these rolls and the floor, in the configurations of the prior art it is not possible to change the label strip roll, for example, when the labeling station is in the operating position. Consequently, a labeling station that is in the operating position must be pivoted out of that position every time it is necessary to change or replace the label and/or backing roll(s), so that the mounting position is within the reach of the operating personnel. This procedure requires not only a reorientation of the labeling station, but also an interruption of production, which is undesirable in practice. The devices of the prior art are also mechanically complex and therefore expensive.

The present application relates to a station for labeling machines that process label strips, and in particular for machines that are suitable for the labeling of inclined surfaces on containers such as, for example, bottles, cans, glasses, cartons etc.

OBJECT OR OBJECTS

The object is to eliminate the disadvantages described above. For this purpose, the present application teaches the realization of a labeling station as described herein below. Advantageous developments of the invention are also described herein below.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is described in greater detail below on the basis of exemplary embodiments.

In the figures.

DESCRIPTION OF EMBODIMENT OR EMBODIMENTS

Developments, advantages and potential applications of the present application are described in greater detail below with reference to the exemplary embodiments and the drawings. All the features described and/or illustrated are the object of the present application, in themselves or in any possible combinations, regardless of their placement in the claims or the references between claims. The text of the claims is simultaneously incorporated by reference into this description.

Figure 1:
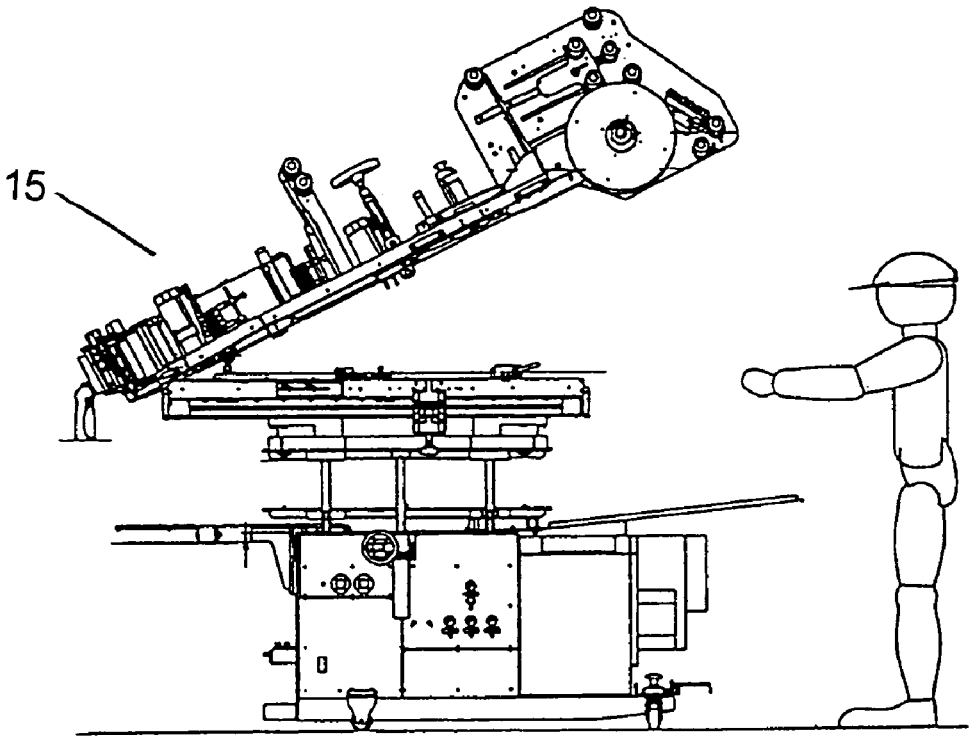
FIG. 1 PRIOR ART
FIG. 1 shows a labeling station of the prior art.
Figure 1A:
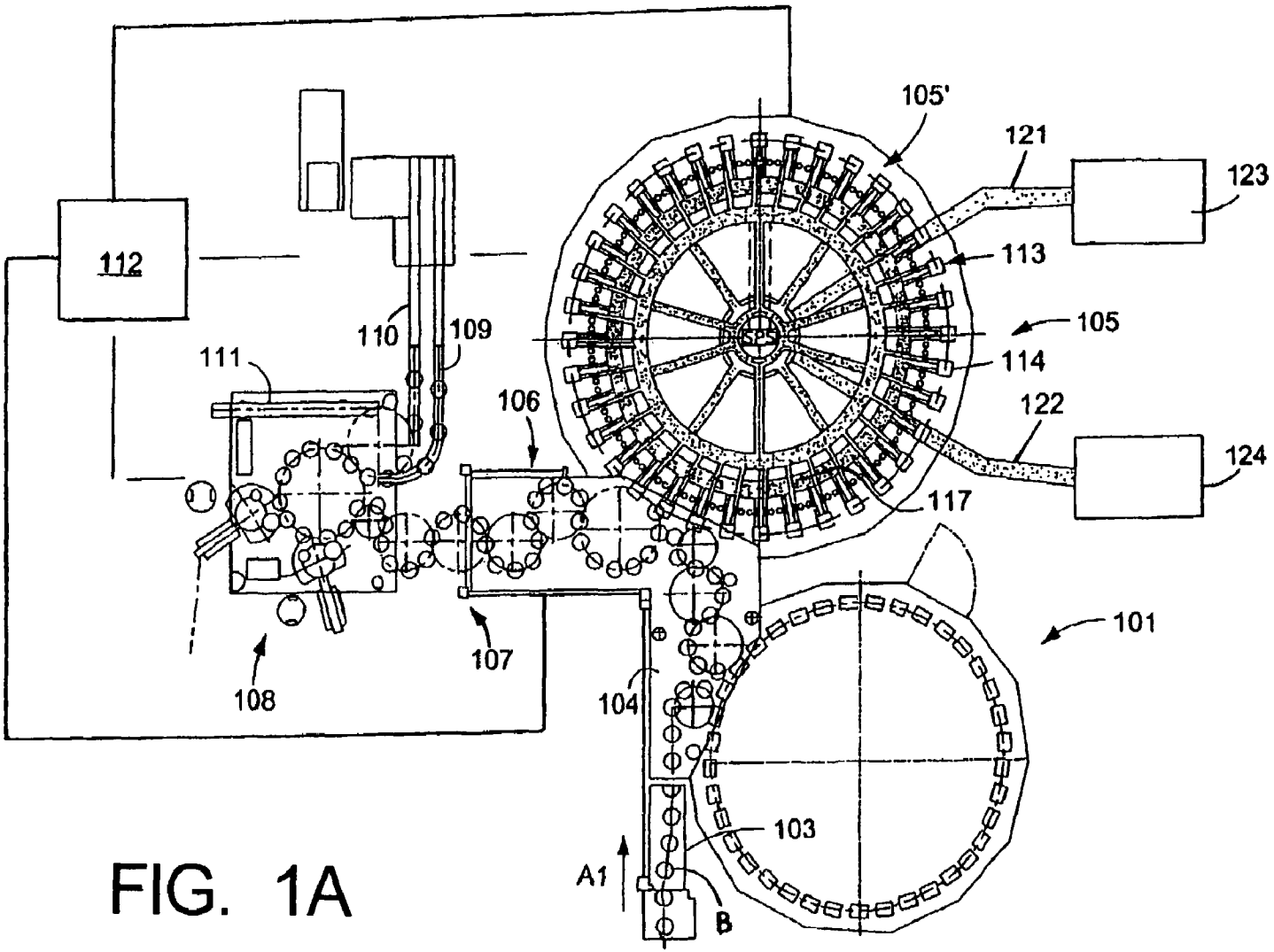
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

In the context of the present application, the term "labeling station" is used to mean the entire apparatus for the labeling of containers located in a handling or labeling position of a labeling machine.

This labeling station comprises essentially the elements listed below, whereby these elements can be present in multiples or not at all in certain configurations: drive, label dispensing edge, label strip roll, backing strip roll, deflector pillars, label strip buffer, e.g. a loop shaft, and a transport device 21 for the labeling station etc.

The term "tandem labeling station" as used in the context of the present application means labeling stations that comprise two labeling stations that operate in alternation. First one of these stations is in use, so that the necessary setting, maintenance, setup or reloading operations can be performed on the second labeling station. Then when the supply of labels in the first station has been used up, for example, the operation switches without interruption to the second station that has previously been prepared. The required operations can then be performed in the first station. This mode of operation makes possible uninterrupted operation of the labeling machine.

As described above, the labeling of inclined container surfaces in labeling stations of the prior art requires an interruption of the labeling process every time it is necessary to replace or change the label and/or backing strip, because the mounting positions of the strip rolls is out of the reach of the operating personnel.

The present application teaches that this problem can be solved by realizing a labeling station that comprises at least two assemblies, whereby these two assemblies can be adjusted with respect to each other around one axis in space.

The present application further teaches that a first assembly 16 contains at least the label dispensing edge 18 and the second assembly 17 contains at least the label strip roll 19.

This method makes it possible to locate and orient the label strip roll 19 so that it remains accessible to the operating personnel even during the labeling of inclined surfaces of the containers.

In particular during the use of tandem labeling stations, the method claimed by the present application makes possible an uninterrupted operation of labeling machines even for the labeling of inclined surfaces of the container.

Figure 2:
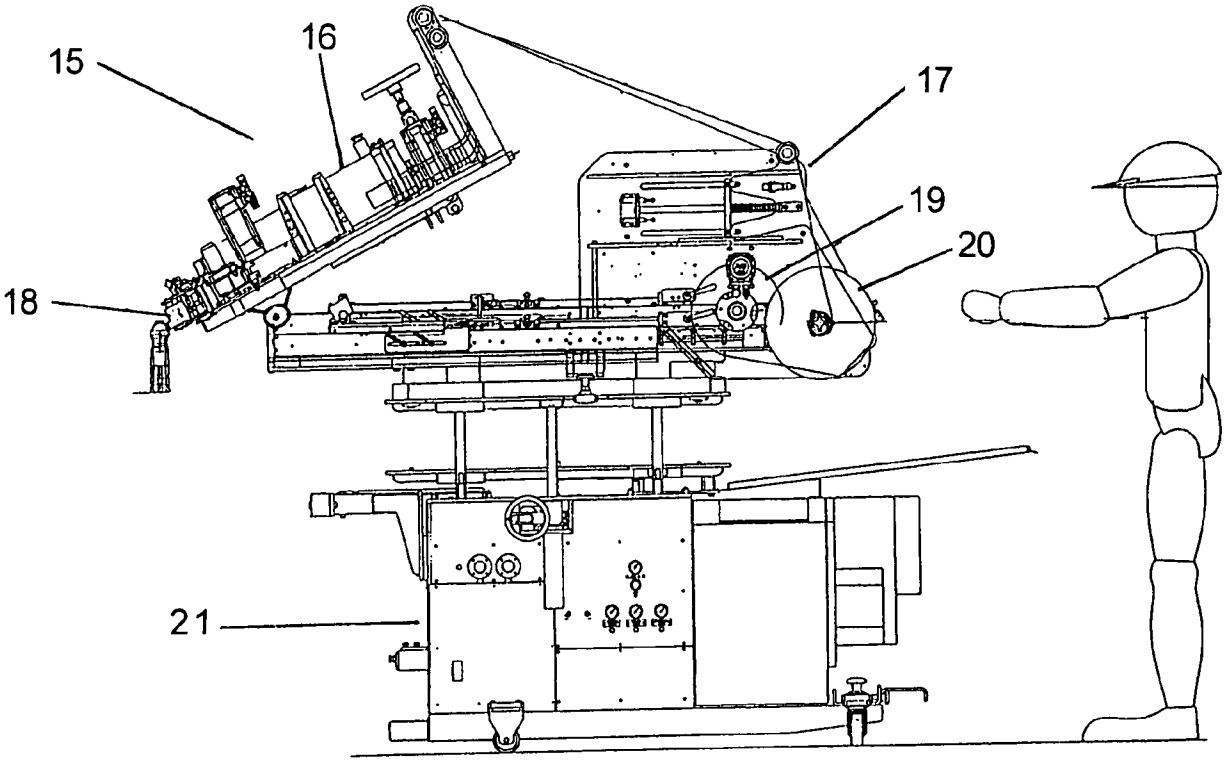
FIG. 2 is a simplified illustration of one possible configuration of a labeling station claimed by the present application, whereby the labeling station in question is located on a transport device 21.

The exemplary embodiment illustrated in FIG. 2 shows a configuration in which the first assembly 16 can be pivoted around an axis of rotation that is located on the second assembly 17. The label dispensing edge 18 can thereby be easily oriented parallel to the surface to be labeled, whereby the rolls for the label and backing strips 19 and 20 respectively associated with the second assembly 17 remain accessible for the operating personnel.

The present application also teaches that the first assembly, in addition to the label dispensing edge 18, contains a drive and a label buffer, preferably a loop shaft.

Figure 2A:
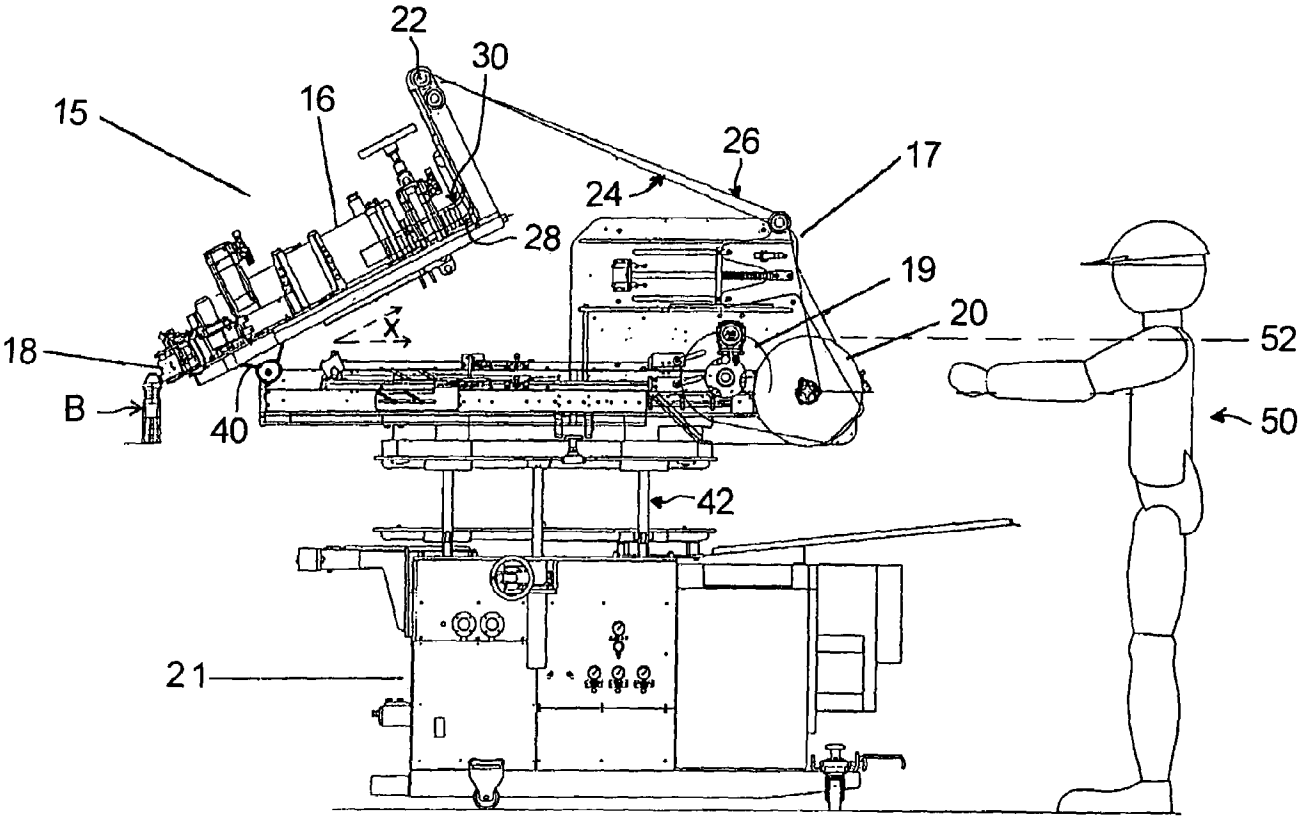
FIG. 2A is similar to FIG. 2 and shows further details of the embodiment shown in FIG. 2.
Figure 2B:
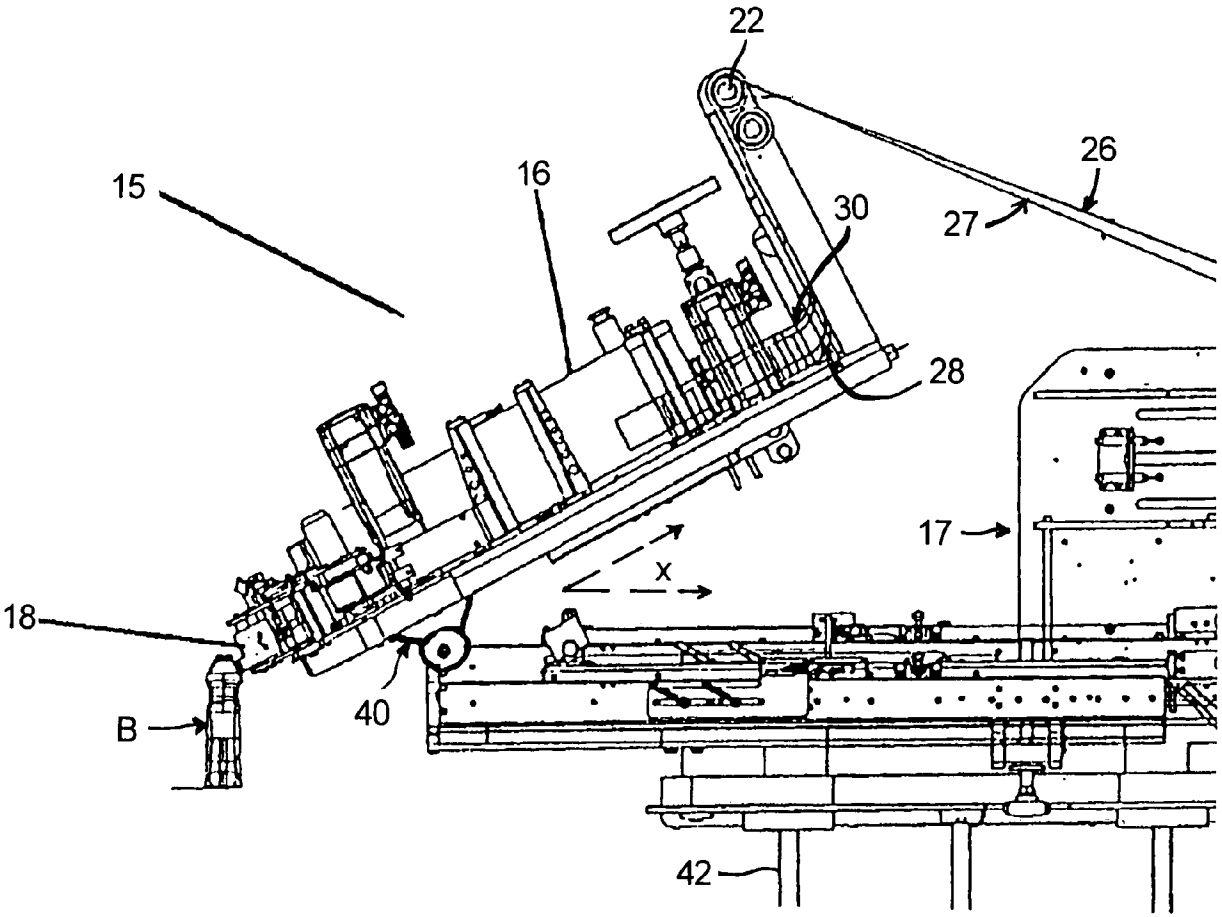
FIG. 2B is an enlargement of the first labeling apparatus shown in FIG. 2A.

FIG. 2A is similar to FIG. 2 and shows further details of the embodiment shown in FIG. 2. In one possible embodiment, the second labeling apparatus 17 can be mounted on a transport device 21. When in the working position, the strip of labels 24 and the backing strip 26 span between the first labeling apparatus 16 and the second labeling apparatus 17. The strip of labels 24 is fed through the second labeling apparatus 17, then spans to the label strip rollers 22. The strip of labels 24 is then fed through the first labeling device 16, twisted or reoriented at a point 30, and then continues until a label arrives at the label dispensing edge 18, where a label is bent at a sharp angle, and therefore becomes detached from the label strip, and is affixed to a bottle B. The empty backing strip 26 is then fed through the first labeling apparatus 16, twisted or reoriented at a point 30, and then continues toward the label strip rollers 22. The backing strip 26 then spans back to the second labeling apparatus 17, where it is guided to the backing strip roller 20 for collection. FIG. 2B is an enlargement of the first labeling apparatus shown in FIG. 2A.

In the embodiment shown in FIGS. 2 and 2A, the transport device 21 comprises a lifting mechanism 42, which lifting mechanism 42 is designed to lift the second labeling apparatus 17, and thus the first labeling apparatus 16, in order to orient the labeling apparatus to accurately place labels on a non-cylindrical inclined surface of a bottle. The lifting mechanism 42 may also lower the first and second labeling apparatuses if necessary. However, the label strip roll 19 and the backing strip roll 20 essentially remain within shoulder height (shown by the line 52) of a person 50, such that the person 50 can easily remove and/or replace the label strip roll 19 and backing strip roll 20.

Figure 3:
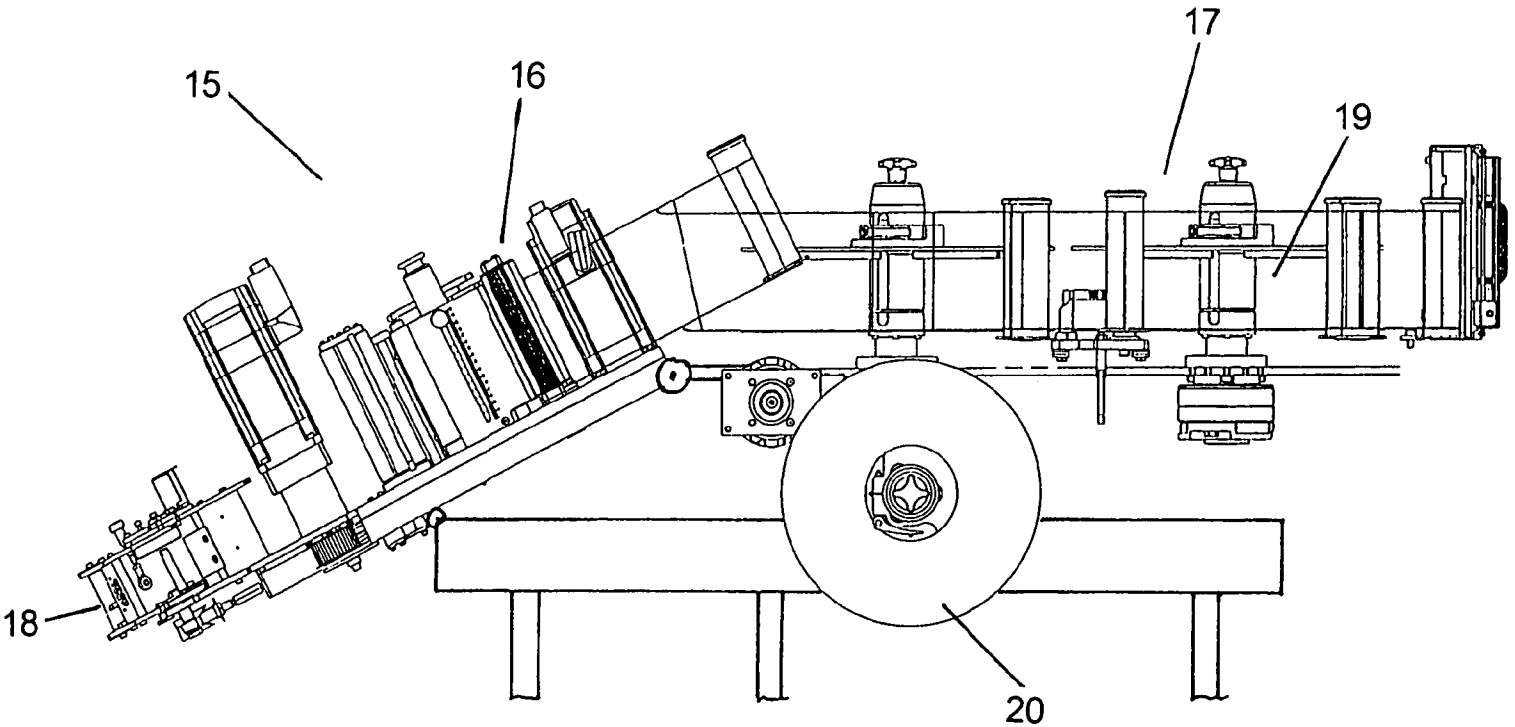
FIG. 3 is also a simplified illustration that shows another possible realization, whereby this particular realization is represented without a transport device 21.

FIG. 3 shows an additional configuration of the present application. In this configuration, the first assembly 16 is located so that it can be pivoted around at least one axis in space on a carrier element, for example on a transport device 21. With regard to the second assembly 17, the present application teaches that it is also fastened to the first assembly 16 so that it can be pivoted around at least one axis in space, as a result of which it becomes possible for the operating personnel to position the second component 17 so that it is optimally accessible.

In an additional configuration, at least the first assembly 16 is realized or located so that the height of the assembly can be adjusted, whereby the height can be adjusted relative to the transport device 21 and/or to the second assembly 17. As a result of this altogether advantageous approach, it becomes possible to optimally and easily orient the label dispensing edge with respect to the surface to be labeled, without having to change the position of the second assembly 17.

The location of the axes of rotation provided for the adjustment of the assemblies can be in any desired angular position in space. It has thereby been found to be particularly advantageous to orient the axis of rotation of the first assembly horizontally or nearly horizontally.

For the realization of tandem labeling stations claimed by the present application, each individual station is realized so that the stations can be moved independently of each other.

Figure 4:
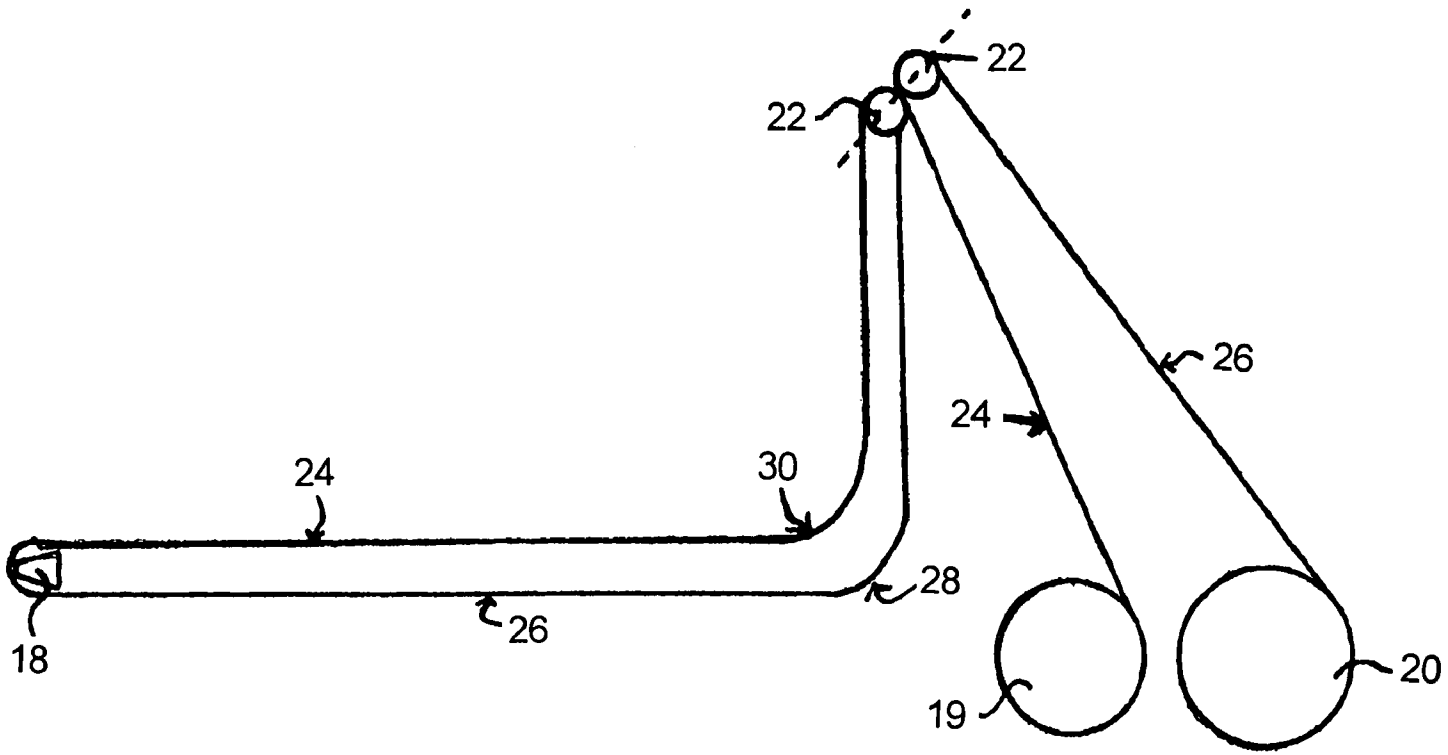
FIG. 4 is a simplified illustration according to one possible embodiment of the tandem labeling station.

FIG. 4 is a simplified illustration of one possible embodiment of the labeling station described herein above. According to this possible embodiment, the label strip roll 19 dispenses a strip of labels 24 in an upward direction toward a set of label strip rollers 22 disposed about an axis Y. The label strip roll 19 is guided over the label strip rolls 22, and then proceeds in a downward direction. The strip of labels 24 is twisted or reoriented at a point 30, such that the strip of labels 24 continues toward the label dispensing edge 18 in the correct orientation for being dispensed by the cutting edge 18 and onto a bottle to be labeled. Once a label has been removed from the strip of labels 24 and placed onto a bottle, the backing strip 26 continues to be cycled through the labeling machine in the opposite direction of travel as the strip of labels 24. The backing strip 26 is then twisted or reoriented at a point 28, such that the backing strip 26 may continue back toward the label strip rolls 22. The backing strip 26 is then fed over the label strip rolls 22, and proceeds in a downward direction toward the backing strip roll 20. Once the backing strip roll 20 is full, it can be easily removed by a user due to its relative proximity to the height of a user's grasp.

Please note that FIG. 4 is a simplified illustration of the functional operation of the labeling machine. In one possible embodiment, the label strip rolls 22 and the label dispensing edge 18 are both located on a first labeling apparatus 16 that is configured to be moved in relation to the first labeling apparatus, while the label strip roll 19 and the backing strip roll 20 are located on a second labeling apparatus 17 that is fixed in place. Since the second labeling apparatus is disposed at about the shoulder level of a person and is never moved, the backing strip roll 20 and the label strip roll 19 can be easily removed and replaced with little effort from the person.

Figure 5:
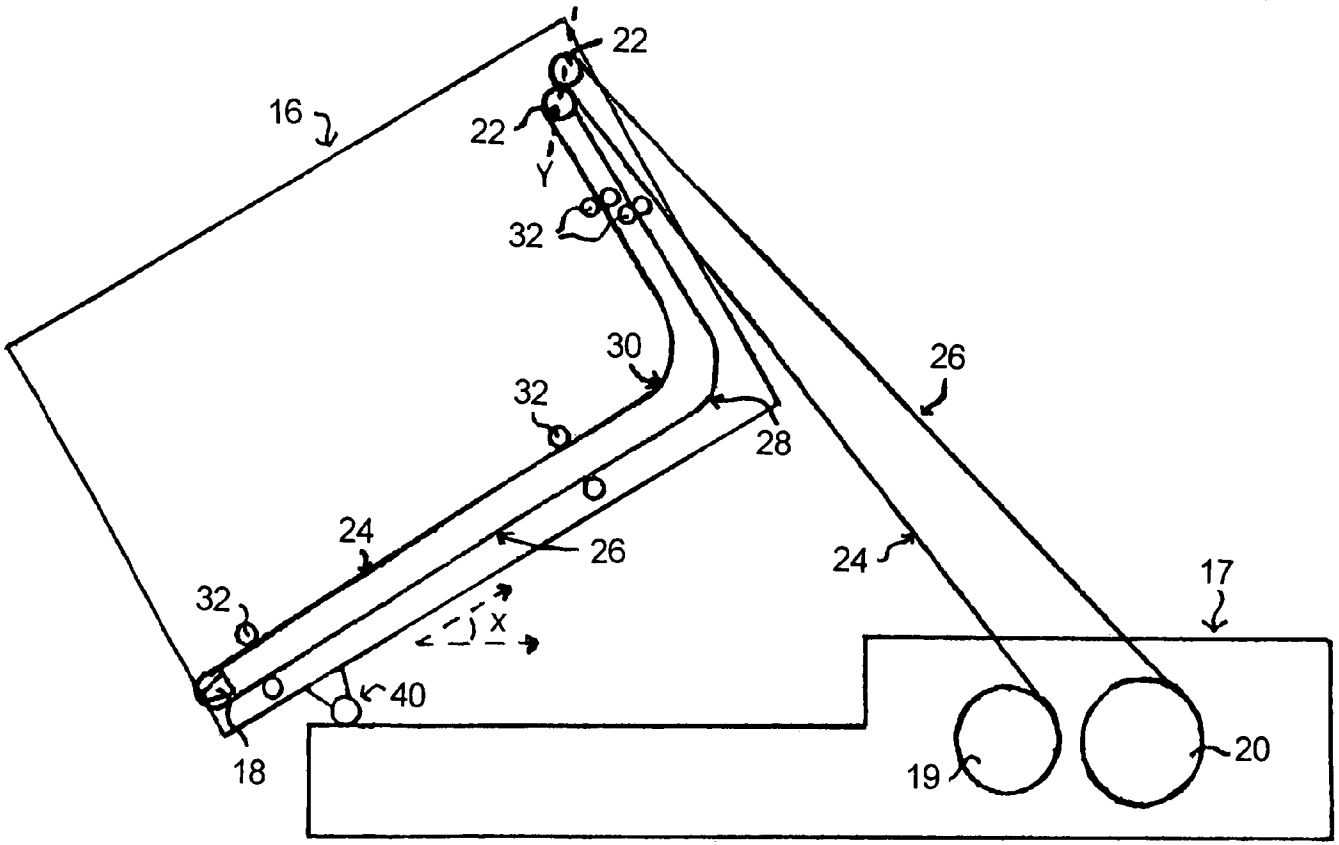
FIG. 5 shows another possible embodiment of the tandem labeling machine in the working position.

FIG. 5 shows further details of the embodiment shown in FIG. 4, and shows the first labeling apparatus 16 in a tilted, working position. Several sets of feed mechanisms 32 are shown in FIG. 5, which feed mechanisms 32 guide the strip of labels 24 and the backing strip 26 through the labeling machine. The mechanism 40 for tilting or pivoting the first labeling apparatus 16 is disposed near the label dispensing edge 18 on the first labeling apparatus 16. FIG. 5 shows the first labeling apparatus 16 tilted approximately at a 30 degree angle X in order to place a label on a non-cylindrical inclined surface of a bottle. It should be noted that the first labeling apparatus 16 could be tilted at any number of angles greater than 30 degrees or less than 30 degrees in order to effectively place a label on a non-cylindrical inclined surface of a bottle. Since the second labeling apparatus 17 remains in one position and is not moved upwards, the label strip roll 19 and the backing strip roll 20 remain in a position that is within reach of a person so that labels or empty backing strip rolls may be removed and replaced with little effort, while the first labeling apparatus 16 may remain in the working position so as not to disrupt the bottle labeling process.

Figure 6:
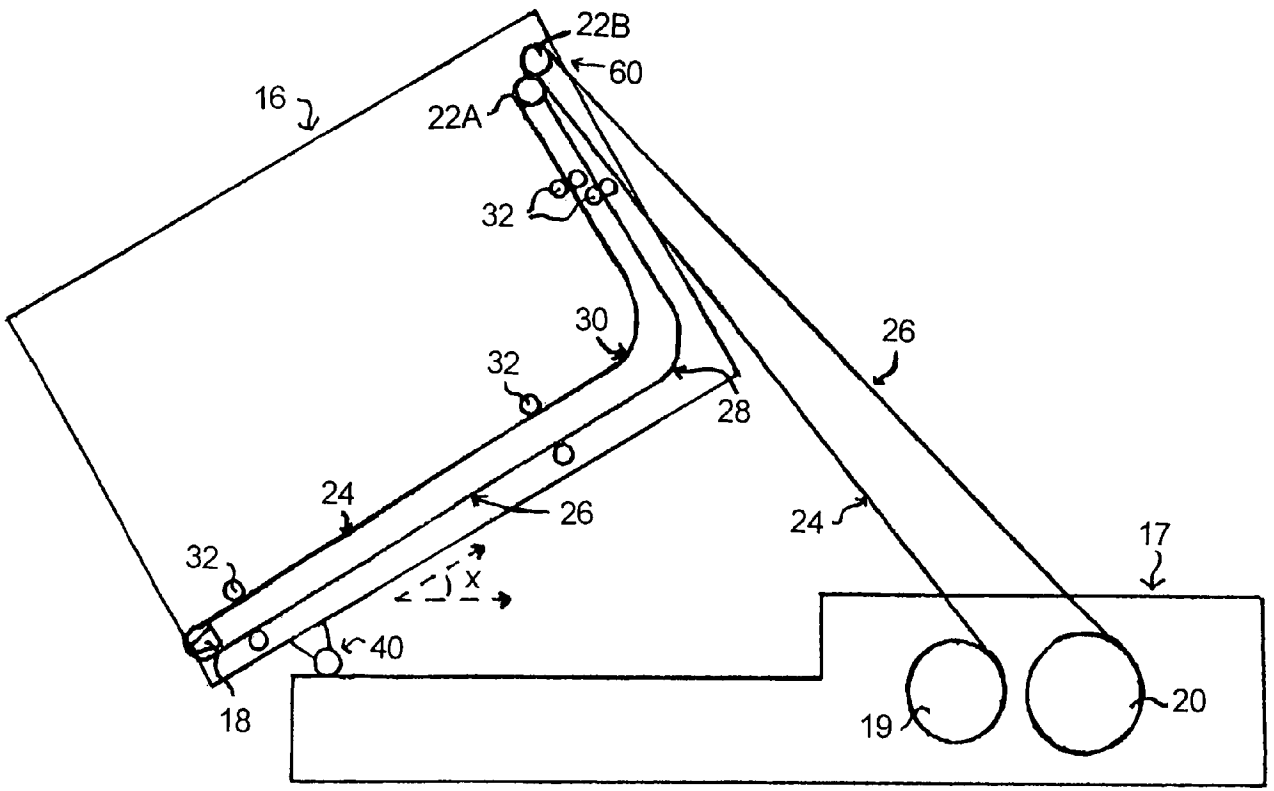
FIG. 6 is similar to FIG. 5 and shows another possible embodiment of the tandem labeling machine.

FIG. 6 is similar to FIG. 5, and shows another possible embodiment of the tandem bottle labeling machine. In this possible embodiment, the label strip roll 22A for guiding the strip of labels 24 16 and the label strip roll 22B for guiding the backing strip 26 at the top of the first labeling apparatus can be disposed parallel to the side 60 of the first labeling apparatus 16. For the sake of clarity, the label strip rolls 22A and 22B are shown at a slightly different angle in relation to the side 60 of the first labeling apparatus 16.

The present application relates to a labeling station for the processing of label strip for use in labeling machines that are constructed using a linear or rotary design, in particular suited for the labeling of inclined areas on containers such as, for example, bottles, cans, glasses, cartons or similar objects, containing at least one label dispensing edge, a drive, a label strip buffer, a label strip roll and a backing strip roll, whereby the labeling station comprises at least two assemblies, whereby the first assembly comprises at least the label dispensing edge and the second assembly at least the label strip roll, whereby the two assemblies can be adjusted with respect to each other, at least with reference to one axis in space.

One feature or aspect of an embodiment is believed at the time of the filing of this patent application to possibly reside broadly in a beverage bottling plant for filling at least partially non-cylindrical beverage bottles having at least one inclined surface that is inclined to the longitudinal axis of a bottle, with liquid beverage material, said beverage bottling plant comprising: a plurality of machines comprising at least a rotary beverage bottle filling machine, a rotary beverage bottle closing machine, and a bottle labeling machine; a first conveyor arrangement being configured and disposed to convey beverage bottles to be filled to said beverage bottle filling machine; said beverage bottle filling machine being configured and disposed to fill beverage bottles with liquid beverage material; said beverage bottle filling machine comprising: a rotor; a rotatable vertical machine column; said rotor being connected to said vertical machine column to permit rotation of said rotor about said vertical machine column; a plurality of beverage bottle filling elements for filling beverage bottles with liquid beverage material being disposed on the periphery of said rotor; each of said plurality of beverage bottle filling elements comprising a container carrier being configured and disposed to receive and hold beverage bottles to be filled; each of said plurality of beverage bottle filling elements being configured and disposed to dispense liquid beverage material into beverage bottles to be filled; at least one liquid reservoir being configured to hold a supply of liquid beverage material; at least one supply line being configured and disposed to connect said at least one liquid reservoir to said beverage bottle filling machine to supply liquid beverage material to said beverage bottle filling machine; a first filling machine star wheel structure being configured and disposed to move beverage bottles into said beverage bottle filling machine; a second filling machine star wheel structure being configured and disposed to move beverage bottles out of said beverage bottle filling machine; a second conveyor arrangement being configured and disposed to convey filled beverage bottles to said beverage bottle closing machine; said beverage bottle closing machine being configured and disposed to close tops of filled beverage bottles; said beverage bottle closing machine comprising: a rotor; a rotatable vertical machine column; said rotor being connected to said vertical machine column to permit rotation of said rotor about said vertical machine column; a plurality of closing devices being disposed on the periphery of said rotor; each of said plurality of closing devices being configured and disposed to place closures on filled beverage bottles; each of said plurality of closing devices comprising a container carrier being configured and disposed to receive and hold filled beverage bottles; a first closing machine star wheel structure being configured and disposed to move filled beverage bottles into said beverage bottle closing machine; a second closing machine star wheel structure being configured and disposed to move filled, closed beverage bottles out of said beverage bottle closing machine; said beverage bottle labeling machine comprising: a rotary bottle carrier being configured and disposed to carry bottles about the periphery of said rotary bottle carrier; said beverage bottle labeling station being disposed adjacent said rotary bottle carrier; said beverage bottle labeling station being configured and disposed to apply self-fastening labels to an inclined surface of an at least partially non-cylindrical bottle on said rotary bottle carrier; said beverage bottle labeling station comprising: a first labeling station apparatus and a second labeling station apparatus; a pivot arrangement being configured to connect said first labeling station apparatus to said second labeling station apparatus; a drive arrangement being configured to drive said pivot arrangement to move said first labeling station apparatus to an angle with respect to said second labeling station apparatus to permit labeling of an inclined surface of an at least partially non-cylindrical bottle; said first labeling station apparatus and said second labeling station apparatus being configured and disposed to permit a strip of initially containing self-fastening labels to be moved from said second labeling station apparatus, to said first labeling station apparatus, and back to said second labeling station apparatus upon labels being dispensed by said first labeling station apparatus; said first labeling station apparatus comprising a plurality of feed mechanisms being configured and disposed to accept a strip of labels from said second labeling apparatus, and to feed a strip of labels through said first labeling station apparatus; said first labeling station apparatus comprising a label dispensing edge being configured and disposed to dispense and permit fastening of self-fastening labels to an inclined surface of an at least partially non-cylindrical bottle; said second labeling station apparatus comprising a plurality of feed mechanisms being configured and disposed to feed a strip of labels through said second labeling apparatus, and to feed a strip of labels to said first labeling station apparatus; said second labeling station apparatus comprising a label strip roll assembly being configured to receive a roll of self-fastening labels, and comprising a backing strip roll assembly being configured to receive a roll of empty backing strip, upon labels being dispensed from said dispensing edge and being fed from said first labeling station apparatus back to said second labeling station apparatus; said label strip roll and said backing strip roll being disposed at approximately shoulder level of a person in order to minimize effort of a person to remove a full backing strip roll, and to remove and replace an empty label strip roll, and being configured to be stationary with respect to the floor of said beverage bottling plant during operation of said beverage bottling plant; said first labeling station apparatus being configured and disposed to be pivoted or moved at an angle with respect to said second labeling station apparatus with said pivot arrangement and being configured to place a self-fastening label on an inclined surface corresponding to an at least partially non-cylindrical bottle.

Yet another feature or aspect of an embodiment is believed at the time of the filing of this patent application to possibly reside broadly in a labeling station for the processing of label strip for use in labeling machines that are constructed using a linear or rotary design, in particular suited for the labeling of inclined areas on containers such as, for example, bottles, cans, glasses, cartons or similar objects, containing at least one label dispensing edge, a drive, a label strip buffer, a label strip roll and a backing strip roll, characterized in that the labeling station comprises at least two assemblies, whereby the first assembly comprises at least the label dispensing edge and the second assembly at least the label strip roll, whereby the two assemblies can be adjusted with respect to each other, at least with reference to one axis in space.

Another feature or aspect of an embodiment is believed at the time of the filing of this patent application to possibly reside broadly in a labeling station, characterized in that the at least one axis in space is oriented essentially horizontally in space.

Yet another feature or aspect of an embodiment is believed at the time of the filing of this patent application to possibly reside broadly in a labeling station, characterized in that the first assembly can be pivoted around at least one axis in space, whereby the second assembly is realized so that it is stationary.

Still another feature or aspect of an embodiment is believed at the time of the filing of this patent application to possibly reside broadly in a labeling station, characterized in that the first assembly is realized so that it can be adjusted vertically with respect to the second assembly.

A further feature or aspect of an embodiment is believed at the time of the filing of this patent application to possibly reside broadly in a labeling station, characterized in that the first assembly can be pivoted around a stationary axis in space, and that the second assembly is connected with the first assembly and can be moved with it.

Another feature or aspect of an embodiment is believed at the time of the filing of this patent application to possibly reside broadly in a labeling station, characterized in that the second assembly contains at least the label strip roll and the backing strip roll.

Yet another feature or aspect of an embodiment is believed at the time of the filing of this patent application to possibly reside broadly in a labeling station, characterized in that the first assembly contains at least the label dispensing edge, a drive and a label strip buffer.

Still another feature or aspect of an embodiment is believed at the time of the filing of this patent application to possibly reside broadly in a labeling station, characterized in that the labeling station in question is a tandem labeling station.

Yet another feature or aspect of an embodiment is believed at the time of the filing of this patent application to possibly reside broadly in a labeling station, characterized in that the individual stations of the tandem labeling station can be adjusted independently of each other.

The components disclosed in the various publications, disclosed or incorporated by reference herein, may possibly be used in possible embodiments of the present invention, as well as equivalents thereof.

Some examples of bottling systems, which may be used or adapted for use in at least one possible embodiment of the present may be found in the following U.S. Patents assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of pivot drives which may possibly be utilized or adapted for use in at least one possible embodiment may possibly be found in the following U.S. Pat. No. 5,757,105, entitled "Pivot drive;" U.S. Pat. No. 4,633,759, entitled "Hydraulic pivot drive;" and U.S. Pat. No. 4,399,718, entitled "Pivot drive for manipulator."

The appended drawings in their entirety, including all dimensions, proportions and/or shapes in at least one embodiment of the invention, are accurate and are hereby included by reference into this specification.

Some examples of control systems which measure operating parameters and learn therefrom that may possibly be utilized or possibly adapted for use in at least one possible embodiment of the present application may possibly be found in the following U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of rotation sensors that may possibly be utilized or possibly adapted for use in at least one possible embodiment of the present application may possibly be found in the following U.S. Pat. No. 6,246,232 issued to Okamura on Jun. 12, 2001; U.S. Pat. No. 6,448,761 issued to Stumpe on Sep. 10, 2002; U.S. Pat. No. 6,474,162 to Voss et al. on Nov. 5, 2002; U.S. Pat. No. 6,498,481 issued to Apel on Dec. 24, 2002; U.S. Pat. No. 6,532,831 issued to Jin et al. on Mar. 18, 2003; and U.S. Pat. No. 6,672,175 issued to Jin et al. on Jan. 6, 2004.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

All of the patents, patent applications and publications recited herein, and in the Declaration attached hereto, are hereby incorporated by reference as if set forth in their entirety herein.

Some examples of servo-motors that may possibly be utilized or possibly adapted for use in at least one possible embodiment of the present application may possibly be found in the following U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025,684 issued to Yasui on Feb. 15, 2000.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of synchronous motors which may possibly be utilized or adapted for use in at least one possible embodiment may possibly be found in the following U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of lifting devices that may possibly be utilized or possibly adapted for use in at least one possible embodiment of the present application may possibly be found in the following patent publications: U.S. Pat. No. 2,535,272 issued to Detrez on Dec. 26, 1950; U.S. Pat. No. 2,642,214 issued to Lippold on Jun. 16, 1953; German Utility Model No. DE-GM 1,923,261 issued on Sep. 9, 1965; German Laid Open Patent Application No. DE-OS 1,532,586 published on Oct. 2, 1969; British Patent No. 1,188,888 issued Apr. 22, 1970; German Laid Open Patent Application No. DE-OS 26 52 910 published on May 24, 1978; German Patent No. DE-PS 26 52 918 issued on Oct. 26, 1978; German Utility Model No. DE-GM 83 04 995 issued on Dec. 22, 1983; German Patent No. DE-PS 26 30 100 issued on Dec. 3, 1981; and German Laid Open Patent Application No. DE-OS 195 45 080 published on Jun. 5, 1997.

The corresponding foreign patent publication applications, namely, Federal Republic of Germany Patent Application No. 10 2005 017 414.0, filed on Apr. 15, 2005, having inventor Holger Stenner, and DE-OS 10 2005 017 414.0 and DE-PS 10 2005 017 414.0, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of computer systems that may possibly be utilized or possibly adapted for use in at least one possible embodiment of the present application may possibly be found in the following U.S. Pat. No. 5,416,480 issued to Roach et al.

on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of labeling machines which may possibly be utilized in at least one possible embodiment may possibly be found in the following U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,543,514, entitled "In-line continuous feed sleeve labeling machine and method;" U.S. Pat. No. 6,378,587, entitled "Cylindrical container labeling machine;" U.S. Pat. No. 6,328,086, entitled "Labeling machine;" U.S. Pat. No. 6,315,021, entitled "Labeling machine;" U.S. Pat. No. 6,263,940, entitled "In-line continuous feed sleeve labeling machine and method;" U.S. Pat. No. 6,199,614, entitled "High speed labeling machine having a constant tension driving system;" U.S. Pat. No. 6,167,935, entitled "Labeling machine; U.S. Pat. No. 6,066,223, entitled "Labeling machine and method; U.S. Pat. No. 6,050,319, entitled "Non-round container labeling machine and method;" and U.S. Pat. No. 6,045,616, entitled "Adhesive station and labeling machine."

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of position sensors or position sensor systems that may be used or adapted for use in at least one possible embodiment of the present invention may be found in the following U.S. Pat. No. 5,794,355, issued to inventor Nickum on Aug. 18, 1998; U.S. Pat. No. 5,520,290, issued to inventors Kumar et al. on May 28, 1996; U.S. Pat. No. 5,074,053, issued to inventor West on Dec. 24, 1991; and U.S. Pat. No. 4,087,012, issued to inventor Fogg on May 2, 1978.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A labeling machine comprising:

a support table;

a first labeling machine assembly and a second labeling machine assembly, each being mounted on said support table;

said first labeling machine assembly being movable with respect to said support table;

said second labeling machine assembly being stationary with respect to said support table;

said first labeling machine assembly comprising:

a label applicator being configured and disposed to apply self-fastening labels to containers; and a feed arrangement being configured and disposed to feed a strip of self-fastening labels to said label applicator, and to remove, upon application of the labels, the empty strip of backing material away from said label applicator;

said second labeling machine assembly comprising:

a label strip roll assembly being configured to receive and store a roll of self-fastening labels;

said label strip roll assembly being disposed at a position a distance away from a floor surface on which said labeling machine is disposed, said position being substantially about at shoulder height of a user;

a backing strip roll assembly being configured to receive and store a roll of backing material;

said backing strip roll assembly being disposed at a position a distance away from a floor surface on which said labeling machine is disposed, said position being substantially about at shoulder height of a user; and a feed arrangement being configured and disposed to unroll and feed a strip of self-fastening labels to said feed arrangement of said first labeling machine assembly, and to receive a strip of backing material from said feed arrangement of said first labeling machine assembly and feed the strip of backing material to said backing strip roll assembly;

a pivot arrangement being connected to said first labeling machine assembly and being configured and disposed to permit pivoting movement and positioning of said first labeling machine assembly at an angle with respect to said second labeling machine assembly to permit labeling of an inclined surface of a container;

said pivot arrangement being disposed at an end of said support table a substantial distance away and separate from said second labeling machine assembly; and said second labeling machine assembly being configured, upon pivoting, angular adjustment of said first labeling machine assembly, to maintain each of said label strip roll assembly and said backing strip roll assembly at said positions being substantially about at shoulder height of a user to permit a user to manually remove a full backing strip roll, to manually install a label strip roll, and to manually remove an empty label strip roll without interruption of the operation of said labeling machine.

2. The labeling machine according to claim 1, wherein:

said first labeling machine assembly comprises a first end disposed adjacent said second labeling machine assembly and a second end disposed opposite said first end; and said first labeling machine assembly is configured to be rotated or pivoted such that said first end of said first labeling machine assembly is moved upwardly and away from said second labeling machine assembly.

3. The labeling machine according to claim 2, wherein:

said first labeling machine assembly is configured and disposed to be moved about an axis which is oriented essentially horizontally; and said second labeling machine assembly is stationary with respect to said first labeling machine assembly.

4. The labeling machine according to claim 3, wherein:

said first labeling machine assembly comprises a label dispensing edge, a drive, and a label strip buffer; and said support table comprises a movable support table to permit movement of said first and second labeling machine assemblies between an operating position adjacent a stream of containers to be labeled and a rest position away from a stream of containers to be labeled.

5. The labeling machine according to claim 4, wherein:

said movable support frame comprises a vertical drive device configured to move said labeling machine up and down to adjust the height of said labeling machine; and said labeling machine is configured to operate in tandem with a second labeling machine in an alternating manner, wherein each labeling machine is configured to be adjusted independently of one another.

6. A labeling machine comprising:

a support table;

a first labeling machine assembly and a second labeling machine assembly, each being mounted on said support table;

said first labeling machine assembly being movable with respect to said support table;

said second labeling machine assembly being stationary with respect to said support table;

said first labeling machine assembly comprising:

a label applicator being configured and disposed to apply self-fastening labels to containers; and a feed arrangement being configured and disposed to feed a strip of self-fastening labels to said label applicator, and to remove, upon application of the labels, the empty strip of backing material away from said label applicator;

said second labeling machine assembly comprising:

a label strip roll assembly being configured to receive and store a roll of self-fastening labels;

said label strip roll assembly being disposed at a position a distance away from a floor surface on which said labeling machine is disposed, said position being substantially about at shoulder height of a user;

a backing strip roll assembly being configured to receive and store a roll of backing material;

said backing strip roll assembly being disposed at a position a distance away from a floor surface on which said labeling machine is disposed, said position being substantially about at shoulder height of a user; and a feed arrangement being configured and disposed to unroll and feed a strip of self-fastening labels to said feed arrangement of said first labeling machine assembly, and to receive a strip of backing material from said feed arrangement of said first labeling machine assembly and feed the strip of backing material to said backing strip roll assembly;

a pivot arrangement being connected to said first labeling machine assembly and being configured and disposed to permit pivoting movement and positioning of said first labeling machine assembly at an angle with respect to said second labeling machine assembly to permit labeling of an inclined surface of a container; and said second labeling machine assembly being configured, upon pivoting, angular adjustment of said first labeling machine assembly, to maintain each of said label strip roll assembly and said backing strip roll assembly at said positions being substantially about at shoulder height of a user to permit a user to manually remove a full backing strip roll, to manually install a label strip roll, and to manually remove an empty label strip roll without interruption of the operation of said labeling machine.

7. The labeling machine according to claim 6, wherein:

said first labeling machine assembly is configured and disposed to be moved about an axis which is oriented essentially horizontally; and said second labeling machine assembly is stationary with respect to said first labeling machine assembly.

8. The labeling machine according to claim 7, wherein:

said first labeling machine assembly comprises a label dispensing edge, a drive, and a label strip buffer; and said support table comprises a movable support table to permit movement of said first and second labeling machine assemblies between an operating position adjacent a stream of containers to be labeled and a rest position away from a stream of containers to be labeled.

9. The labeling machine according to claim 8, wherein:

said movable support frame comprises a vertical drive device configured to move said labeling machine up and down to adjust the height of said labeling machine; and said labeling machine is configured to operate in tandem with a second labeling machine in an alternating manner, wherein each labeling machine is configured to be adjusted independently of one another.

10. A labeling machine comprising:

a support;

a first labeling machine assembly and a second labeling machine assembly being supported on said support;

said first labeling machine assembly comprising:

a label applicator being configured and disposed to apply self-fastening labels to containers; and a feed arrangement being configured and disposed to feed a strip of self-fastening labels to said label applicator, and to remove, upon application of the labels, the empty strip of backing material away from said label applicator;

said second labeling machine assembly comprising:

a label strip roll assembly being configured to receive and store a roll of self-fastening labels;

said label strip roll assembly being disposed at a position a distance away from a floor surface on which said labeling machine is disposed, said position being substantially about at shoulder height of a user;

a backing strip roll assembly being configured to receive and store a roll of backing material; and a feed arrangement being configured and disposed to unroll and feed a strip of self-fastening labels to said feed arrangement of said first labeling machine assembly, and to receive a strip of backing material from said feed arrangement of said first labeling machine assembly and feed the strip of backing material to said backing strip roll assembly;

a movement arrangement being connected to said first labeling machine assembly and being configured and disposed to permit movement and positioning of said first labeling machine assembly at an angle with respect to said second labeling machine assembly to permit labeling of an inclined surface of a container; and said second labeling machine assembly being configured, upon angular adjustment of said first labeling machine assembly, to maintain said label strip roll assembly at said position being substantially about at shoulder height of a user to permit a user to manually install a label strip roll and to manually remove an empty label strip roll without interruption of the operation of said labeling machine.

11. The labeling machine according to claim 10, wherein:

said second labeling machine is stationary with respect to said support;

said movement arrangement comprises a pivot arrangement to permit pivoting movement and positioning of said first labeling machine assembly; and said pivot arrangement being disposed at an end of said support table a substantial distance away and separate from said second labeling machine assembly.

12. The labeling machine according to claim 11, wherein:

said first labeling machine assembly comprises a first end disposed adjacent said second labeling machine assembly and a second end disposed opposite said first end; and said first labeling machine assembly is configured to be rotated or pivoted such that said first end of said first labeling machine assembly is moved upwardly and away from said second labeling machine assembly.

13. The labeling machine according to claim 12, wherein:

said first labeling machine assembly is configured and disposed to be moved about an axis which is oriented essentially horizontally; and said second labeling machine assembly is stationary with respect to said first labeling machine assembly.

14. The labeling machine according to claim 13, wherein:

said first labeling machine assembly comprises a label dispensing edge, a drive, and a label strip buffer; and said support table comprises a movable support table to permit movement of said first and second labeling machine assemblies between an operating position adjacent a stream of containers to be labeled and a rest position away from a stream of containers to be labeled.

15. The labeling machine according to claim 14, wherein:

said movable support frame comprises a vertical drive device configured to move said labeling machine up and down to adjust the height of said labeling machine; and said labeling machine is configured to operate in tandem with a second labeling machine in an alternating manner, wherein each labeling machine is configured to be adjusted independently of one another.

16. The labeling machine according to claim 10, wherein:

said second labeling machine is stationary with respect to said support; and said movement arrangement comprises a pivot arrangement connected to and between said first labeling machine assembly and said second labeling machine assembly, and configured and disposed to permit pivoting movement and positioning of said first labeling machine assembly.

17. The labeling machine according to claim 16, wherein:

said first labeling machine assembly is configured and disposed to be moved about an axis which is oriented essentially horizontally; and said second labeling machine assembly is stationary with respect to said first labeling machine assembly.

18. The labeling machine according to claim 17, wherein said first labeling machine assembly comprises a label dispensing edge, a drive, and a label strip buffer.

19. The labeling machine according to claim 18, wherein said support table comprises a movable support table to permit movement of said first and second labeling machine assemblies between an operating position adjacent a stream of containers to be labeled and a rest position away from a stream of containers to be labeled.

20. The labeling machine according to claim 19, wherein:

said movable support frame comprises a vertical drive device configured to move said labeling machine up and down to adjust the height of said labeling machine; and said labeling machine is configured to operate in tandem with a second labeling machine in an alternating manner, wherein each labeling machine is configured to be adjusted independently of one another.

* * * * *

UNITED STATES PATENT AND TRADEMARK OFFICE

CERTIFICATE OF CORRECTION

PATENT NO. : 7,404,275 B2
APPLICATION NO. : 11/404580
DATED : July 29, 2008
INVENTOR(S) : Holger Stenner It is certified that error appears in the above-identified patent and that said Letters Patent is hereby corrected as shown below:

Title Page; On the patent cover page, between item 65 and item 51, insert --(30) Foreign Application Priority Data April 15, 2005 (DE) 10 2005 017 414.0--

Signed and Sealed this

Eleventh Day of May, 2010

David J. Kappos

David J. Kappos
*Director of the United States Patent and Trademark Office*